US007442007B2

(12) United States Patent
Bibor et al.

(10) Patent No.: US 7,442,007 B2
(45) Date of Patent: Oct. 28, 2008

(54) ANGLED BLADE FIRTREE RETAINING SYSTEM

(75) Inventors: Olivier Bibor, Montreal (CA); Toufik Djeridane, St. Bruno (CA)

(73) Assignee: Pratt & Whitney Canada Corp., Longueuil (CA)

( * ) Notice: Subject to any disclaimer, the term of this patent is extended or adjusted under 35 U.S.C. 154(b) by 502 days.

(21) Appl. No.: 11/142,340

(22) Filed: Jun. 2, 2005

(65) Prior Publication Data

US 2006/0275125 A1 Dec. 7, 2006

(51) Int. Cl.
*F01D 5/18* (2006.01)
*F01D 5/32* (2006.01)

(52) U.S. Cl. ..... 416/97 R; 416/193 A; 416/219 R; 416/220 R; 416/248

(58) Field of Classification Search ..... 416/193 A, 416/219 R, 220 R, 221, 248, 95, 96 R, 96 A, 416/97 R
See application file for complete search history.

(56) References Cited

U.S. PATENT DOCUMENTS 3,158,353 A * 11/1964 Reid et al. ..... 416/220 R
3,692,429 A * 9/1972 Redding ..... 416/219 R
3,741,681 A * 6/1973 De Witt ..... 416/95
4,451,205 A * 5/1984 Honda et al. ..... 416/219 R
5,067,876 A 11/1991 Moreman, III
RE33,954 E 6/1992 Honda et al.
5,222,865 A * 6/1993 Corsmeier ..... 416/193 A
5,310,318 A 5/1994 Lammas et al.
5,431,542 A 7/1995 Weisse et al.
5,511,945 A * 4/1996 Glezer et al. ..... 416/96 R
5,984,636 A * 11/1999 Fahndrich et al. ..... 416/96 R
5,993,162 A 11/1999 Weisse et al.
6,155,788 A 12/2000 Beckford et al.
6,835,046 B2 * 12/2004 Strassberger et al. ..... 416/97 R
7,189,056 B2 * 3/2007 Girgis et al. ..... 415/115
2006/0263218 A1 * 11/2006 Leghzaouni et al. ..... 416/97 R

* cited by examiner

*Primary Examiner*—Christopher Verdier
(74) *Attorney, Agent, or Firm*—Ogilvy Renault LLP

(57) ABSTRACT

A blade root retaining system for attachment of a turbine blade to a turbine disc of a gas turbine engine comprises a blade root having at least one projection on each of opposite sides thereof, the projection extending from a leading edge to a trailing edge of the blade in an axial direction toward a longitudinal axis of the gas turbine engine. The blade root is received in an attachment slot defined through a periphery of the turbine disc. The attachment slot is configured in shape and direction for retaining the blade root.

8 Claims, 4 Drawing Sheets

ANGLED BLADE FIRTREE RETAINING SYSTEM

TECHNICAL FIELD

The invention relates generally to gas turbine engines, and more particularly, to a blade root retaining system for attachment of a turbine blade to a turbine disc of gas turbine engines.

BACKGROUND OF THE ART

A conventional gas turbine engine includes various rotor blades in the fan, compressor, and turbine sections thereof, which are removably mounted to respective rotor discs. Each of the rotor blades includes a blade root at the radially inner end thereof. Each of the blade roots conventionally includes one or more pairs of lobes which can axially slide into and be retained in one of a plurality of axially extending attachment slots in the periphery of the rotor disc. In high pressure turbine rotor assemblies, blade fixing attachments with turbine discs have been conventionally oriented in a direction substantially parallel to the engine axis. The constant quest to improve the efficiency of engines as a whole, and in the turbine area in particular, have lead to changes in the geometry of the gas path, resulting in an increase in the stresses on blades and blade firtrees, and an increasing need for a blade cooling flow provided at high pressure ratios. It has been found that in the conventional blade fixing attachment configurations, significant pressure loss of cooling air flow occurs through Tangential On Board Ingestion (TOBI) systems, especially at the point of blade entry.

Accordingly, there is a need to provide an improved blade root retaining system for turbine assemblies of gas turbine engines in order to meet the demanding requirements of various aspects of high efficiency gas turbine engines.

SUMMARY OF THE INVENTION

It is therefore an object of the present invention to provide an improved blade root retaining system for a rotor assembly of a gas turbine engine.

In one aspect, the present invention provides a blade for a turbine rotor assembly, which comprises an airfoil section and a blade root thereof for engagement with an attachment slot of a turbine disc. The blade root includes at least one projection on each of opposite sides thereof. The projection extends in a direction to define an acute angle in a radial plane of the turbine rotor assembly with respect to a longitudinal axis of the turbine rotor assembly when the blade is mounted thereto.

In another aspect, the present invention provides a turbine root assembly of a gas turbine engine, which comprises a rotor disc; and an array of rotor blades extending outwardly from a periphery of the rotor disc. Each of the rotor blades includes an airfoil section, a blade root and platform segments extending laterally from opposed sides of the airfoil, in an opposing relationship with corresponding platform segments of adjacent rotor blades. There are means for attaching each rotor blade to a corresponding attachment slot extending through the periphery of the rotor disc, wherein the blade root and the attachment slot are contoured to provide abutting retaining surfaces of the respective blade root and the attachment slot. The abutting retaining surfaces of the respective blade root and attachment slot extend from a leading edge to a trailing edge of the turbine blade in a direction toward a longitudinal axis of the gas turbine engine.

In another aspect, the present invention provides a rotor assembly of a gas turbine engine, which comprises a rotor disc defining a plurality of attachment slots circumferentially spaced apart one from another and extending axially through a periphery thereof; and an array of rotor blades extending outwardly from the periphery of the rotor disc, each of the rotor blades including an airfoil section, a blade root and a platform segment extending laterally from sides of the airfoil into opposing relationship with corresponding platform segments of adjacent rotor blades. Each pair of blade roots and the attachment slots are contoured in a substantially entire axial length of the rotor assembly in order to provide abutting retaining surfaces of the respective blade root and the attachment slot from a leading edge to a trailing edge of the blade. The abutting retaining surfaces of the respective blade root and the attachment slot extend from a leading edge to a trailing edge of the blade in a direction toward a longitudinal axis of the gas turbine engine. The blade root and the attachment slot in combination define a tapered cavity therebetween extending substantially along said entire axial length.

Further details of these and other aspects of the present invention will be apparent from the detailed description and figures included below.

BRIEF DESCRIPTION OF THE DRAWINGS

Reference is now made to the accompanying drawings depicting aspects of the present invention, in which.

DETAILED DESCRIPTION OF THE PREFERRED EMBODIMENTS

Figure 1:
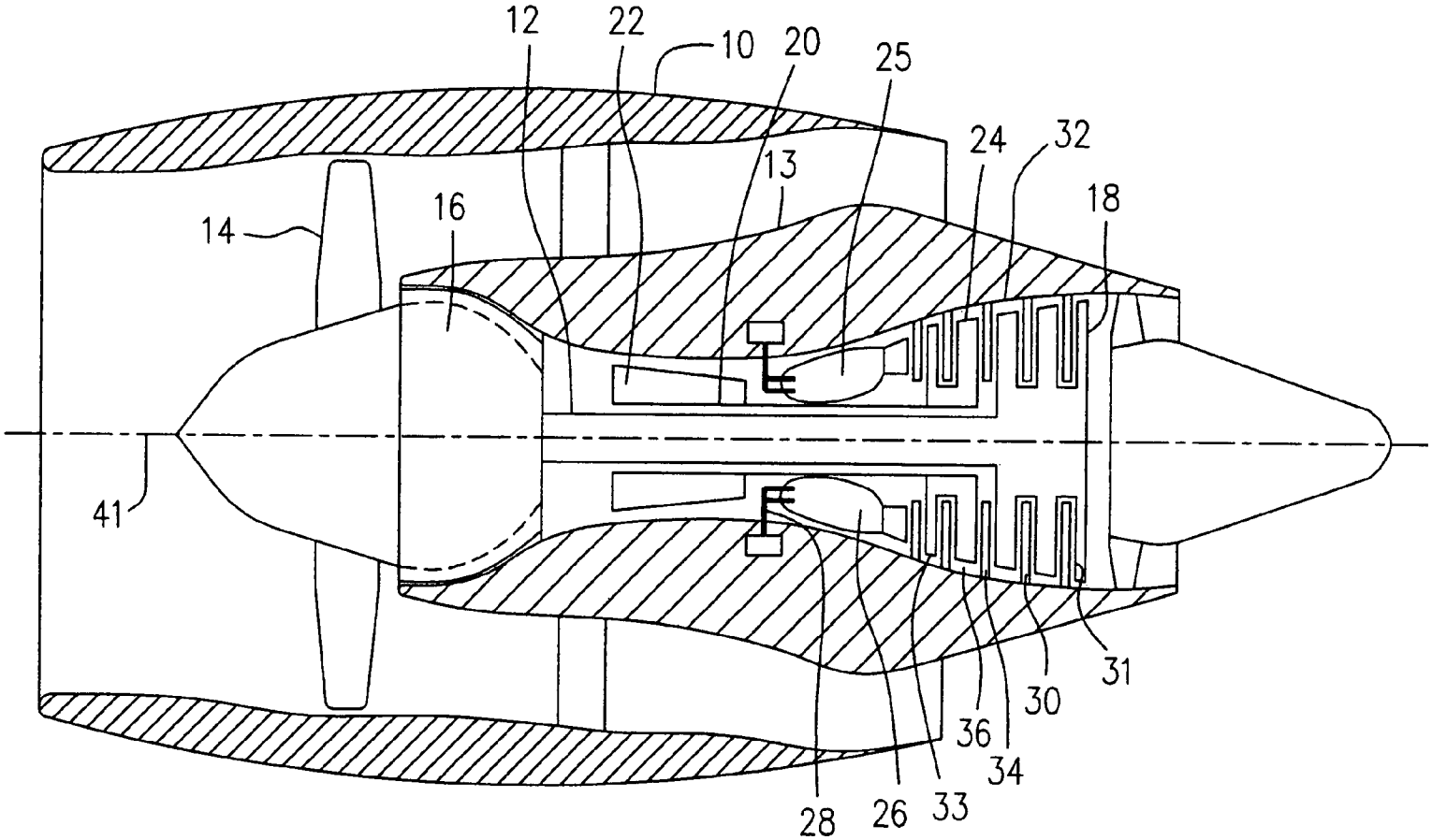
FIG. 1 is a schematic cross-sectional view of a turbofan gas turbine engine, as an example illustrating an application of the present invention.

Referring to FIG. 1, a turbofan gas turbine engine incorporating an embodiment of the present invention is presented as an example of the application of the present invention and includes a housing or a nacelle 10, a core casing 13, a low pressure spool assembly seen generally at 12 which includes a fan assembly 14, a low pressure compressor assembly 16 and a low pressure turbine assembly 18, and a high pressure spool assembly seen generally at 20 which includes a high pressure compressor assembly 22 and a high pressure turbine assembly 24. The core casing 13 surrounds the low and high pressure spool assemblies 12 and 20 to define a main fluid path (not indicated) therethrough. In the main fluid path there is provided a combustor seen generally at 25 with fuel injecting means 28 to constitute a gas generator section 26. The compressor assemblies 16 and 22 drive a main air flow (not indicated) along the main fluid path and provide a cooling air source. The low and high pressure turbine assemblies 18, 24 include a plurality of stator vane stages 30 and rotor stages 31. Each rotor stage 31 has a plurality of rotor blades 33 rotatably mounted within a turbine shroud assembly 32 and each stator vane stage 30 includes a turbine ring assembly 34 which is positioned immediately upstream and/or downstream of rotor stage 31, for directing hot combustion gases into or out of a section of an annular gas path 36, which is in turn a section of the main fluid path downstream of the gas generator section 26, and through the stator vane stages 30, and rotor stages 31.

Figure 2:
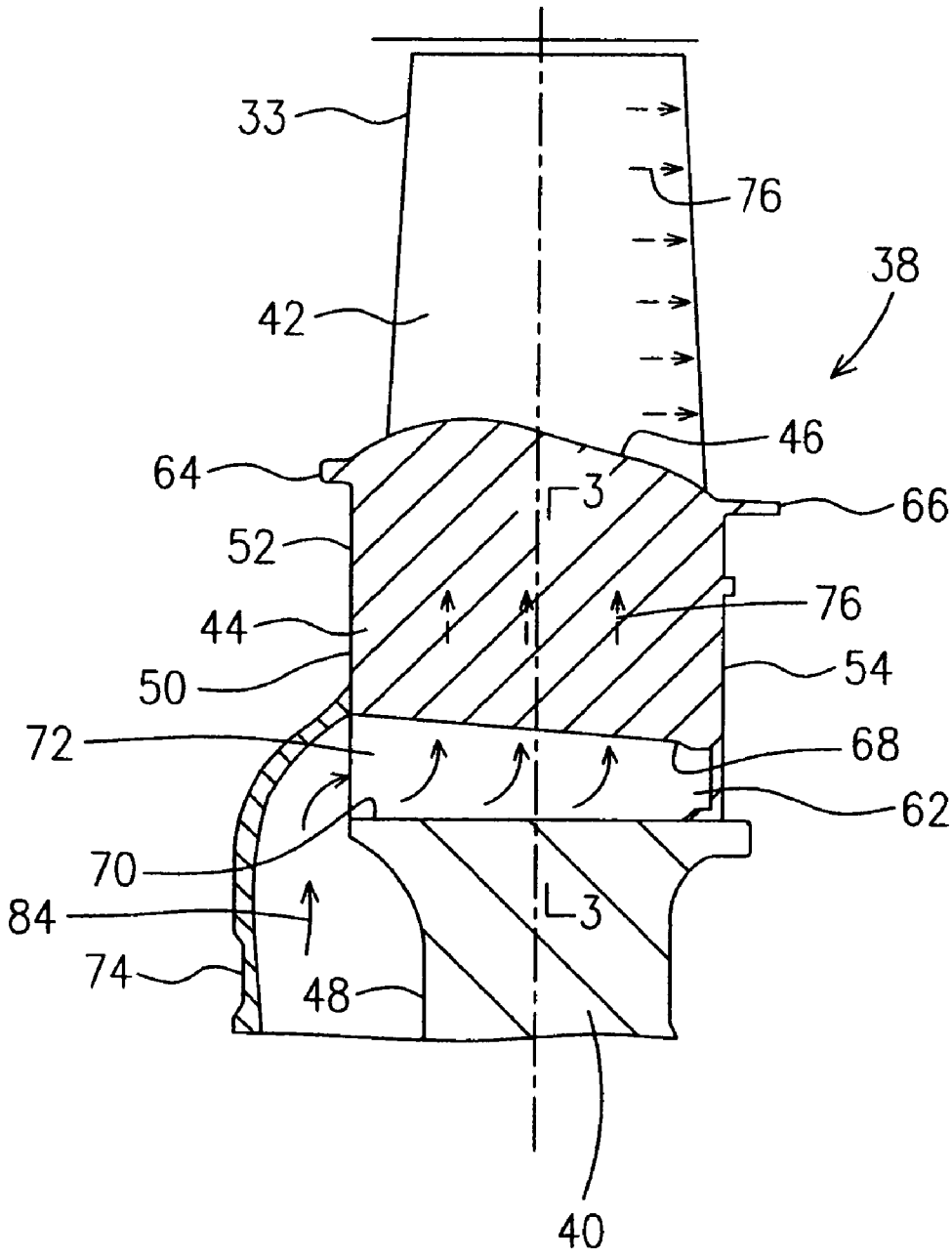
FIG. 2 is a schematic partial cross-sectional view of a turbine rotor assembly of the engine of FIG. 1, showing one embodiment of the present invention.
Figure 4:
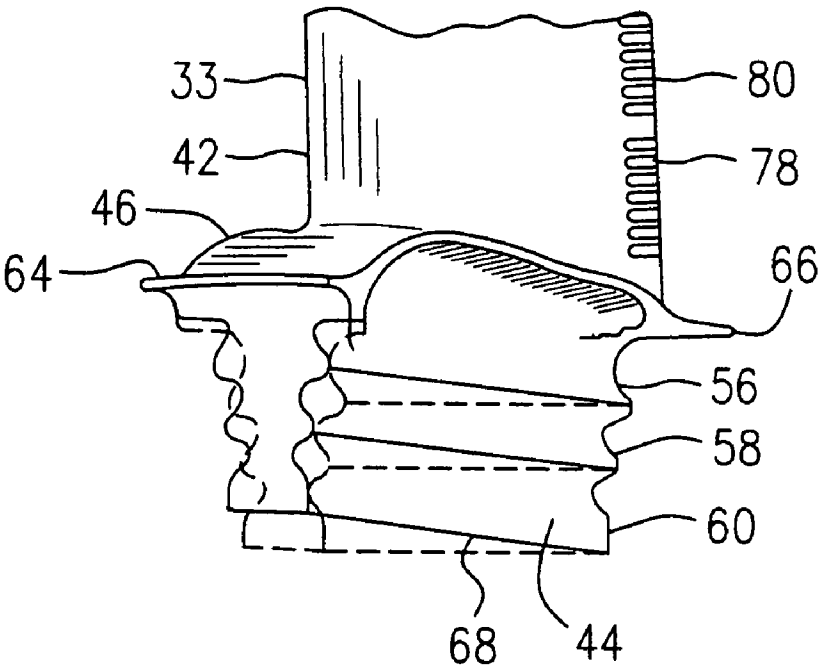
FIG. 4 is a partial and perspective view of the front of a turbine blade of the embodiment of the present invention illustrated in FIG. 2.
Figure 3:
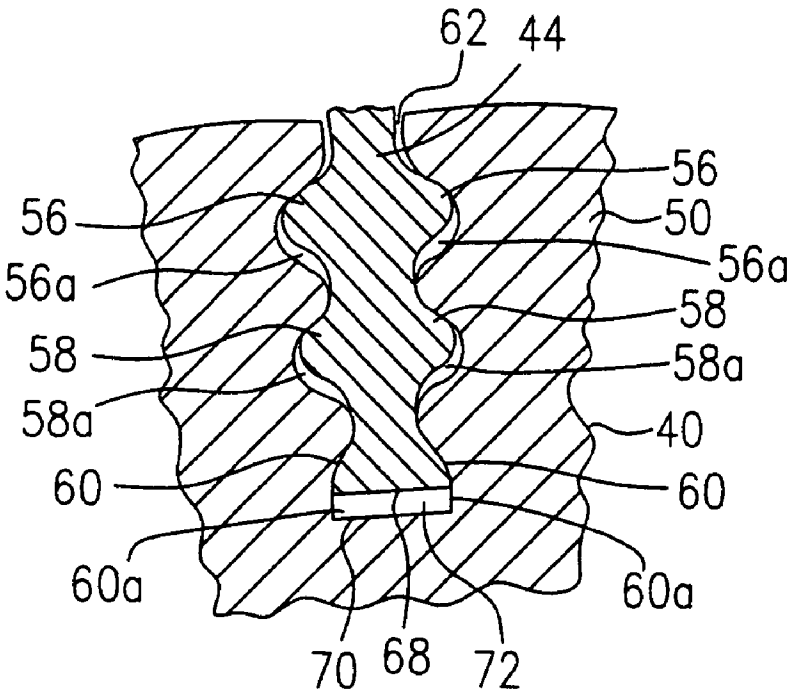
FIG. 3 is a schematic partial cross-sectional view of the turbine rotor assembly of FIG. 2, taken along line 3-3 in FIG. 2, showing the abutting retaining surfaces of the blade firtree and the corresponding attachment slot of the disc.

Referring to FIGS. 1 and 2, a rotor assembly, for example a turbine rotor assembly 38 in a first rotor stage 31 of the high pressure turbine assembly 24, is described herein according to one embodiment of the present invention. The turbine rotor assembly 38 includes a turbine rotor disc 40 mounted to a rotating shaft (not indicated) of the high pressure spool assembly 20 and is rotatable about a longitudinal axis 41 of the engine, which is also the longitudinal axis of the turbine rotor assembly 38. An array of rotor blades 33 (only one shown in FIG. 2) extend outwardly from a periphery of the turbine rotor disc 40. Each of the rotor blades 33 includes an airfoil section 42, a root section 44 and platform segments 46 extending laterally from opposed sides of the airfoil section 42 into opposing relationship with corresponding platform segments 46 of adjacent rotor blades 33.

The rotor assembly 38 is described in greater detail with reference to FIGS. 2-5. The turbine rotor disc 40 includes a web section 48 extending radially outward from a hub (not shown) which is mounted to the rotating shaft (not indicated) of the high pressure spool assembly 20 of FIG. 1, and a rim section 50 extending radially outward from the web section 48. Rim section 50 has an axial thickness defined by a front face 52 and rear face 54.

Root section 44 of each turbine rotor blade 33 includes at least one projection on each of opposite sides thereof, which in this embodiment are, for example, formed by a series of lobes 56, 58 and 60, having decreasing circumferential widths from the radially outermost lobe 56 ("top lobe"), to the radially innermost lobe 60 ("bottom lobe"), with the radially central lobe 58 ("mid lobe") disposed therebetween and having an intermediate lobe width. The root section 44 of such a multi-lobed type is often referred to as a firtree, because of this characteristic shape.

Turbine rotor disc 40 further includes a plurality of attachment slots 62 (only one shown in FIG. 3) circumferentially spaced apart one from another and extending axially through the periphery of the turbine rotor disc 40 which in this embodiment, is the entire axial thickness of the rim 50. The axial attachment slot 62 includes a series of axial recesses or fillets 56*a*, 58*a* and 60*a* defined in opposite side walls (not indicated) of slot 62, which substantially conform in both shape and direction, to the firtree of root section 44, so as to form abutting retaining surfaces of the respective root section 44 and slot 62 for retaining blade 33 in the turbine rotor assembly 38 under the high temperature, high stress environment of the rotating turbine. The abutting retaining surfaces extend substantially along both the entire axial length of the turbine rotor blade 33 and the axial thickness of the rim 50 of the turbine rotor disc 50. The abutting retaining surface of the attachment slot is formed by at least one recess in each of opposite side walls of the attachment slot.

The platform segments 46 of turbine rotor blades 33, in combination form an inner section of an inner annular wall of the gas path 36 in FIG. 1. The platform segments 46 of the turbine rotor blades 33 are preferably shaped to provide a flared gas path in order to achieve high levels of efficiency in engine performance. As a result, the platform segments 46 of each turbine rotor blade 33 have a varying radius with respect to the longitudinal axis 41 of the engine of FIG. 1 such that a radius at a leading edge 64 of the platform segments 46 is greater than a radius at a trailing edge 66 thereof. In a conventional rotor blade fixing attachment configuration, as shown in broken lines in FIG. 4, having a firtree substantially parallel to the longitudinal axis 41 of the engine of FIG. 1, this unevenness in height between the leading edge 64 and the trailing edge 66 of platform segments 46 actually causes an increase in weight because of the additional supporting material underneath. The increased weight translates into higher stresses on the blade fixing attachment configuration, due to centrifugal loads during engine operation.

In this embodiment of the present invention, the firtree of the root section 44 of each turbine rotor blade 33 is angled slightly toward the longitudinal axis 41 of the engine of FIG. 1. Lobes 56, 58 and 60 preferably extend from a leading edge to a trailing edge of the turbine rotor blade 33 (generally indicated by the leading edge 64 to the trailing edge 66 of the platform segments 46 of the turbine rotor blade 33) in a direction towards the longitudinal axis 41 of the engine of FIG. 1, as illustrated by the firtrees of the root section 44 shown in solid lines in FIG. 4, thereby defining an acute angle with respect to the longitudinal axis 41. The root section 44 has a bottom surface 68 preferably extending from the leading edge to the trailing edge of the turbine rotor blade 33 in a direction toward the longitudinal axis 41 of the engine of FIG. 1. The bottom surface 68 is preferably parallel to the lobes 56, 58 and 60. Thus, similar to the platform segments 46, with respect to the longitudinal axis 41 of FIG. 1, a radius at a leading edge of the bottom surface 68 is greater than a radius at a trailing edge of the bottom surface 68. Therefore, the increased weight due to the additional supporting material beneath the uneven height platform segments 46 in the conventional configuration shown in the broken lines, is removed, thereby relatively reducing stresses caused by centrifugal loads during engine operation. The bottom surface of the blade root is substantially parallel to the lobes.

The axial attachment slots 62 in rim 50 of turbine rotor disc 40 and the recesses or fillets 56*a*, 58*a* and 60*a*, extend in the same direction as lobes 56, 58, and 60 of the root section 44 of the turbine rotor blade 33 in order to provide adequate retaining surfaces thereof when the root section 44 of the turbine rotor blade 33 slides axially into the attachment slot 62. The slot 62 includes a bottom surface 70 which preferably extends in an axial direction substantially parallel to the longitudinal axis 41 of the engine of FIG. 1, thereby in combination with the angled bottom surface 68 of the root section 44 of the turbine rotor blade 33, forming a tapered cavity 72 therebetween.

Figure 6:
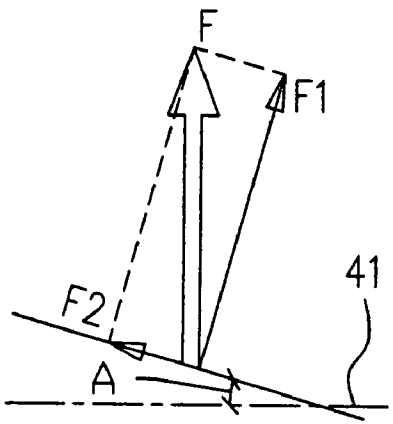
FIG. 6 is a graphic illustration of forces on the blade firtree derived from the centrifugal load of the rotor blade during engine operation.
Figure 5:
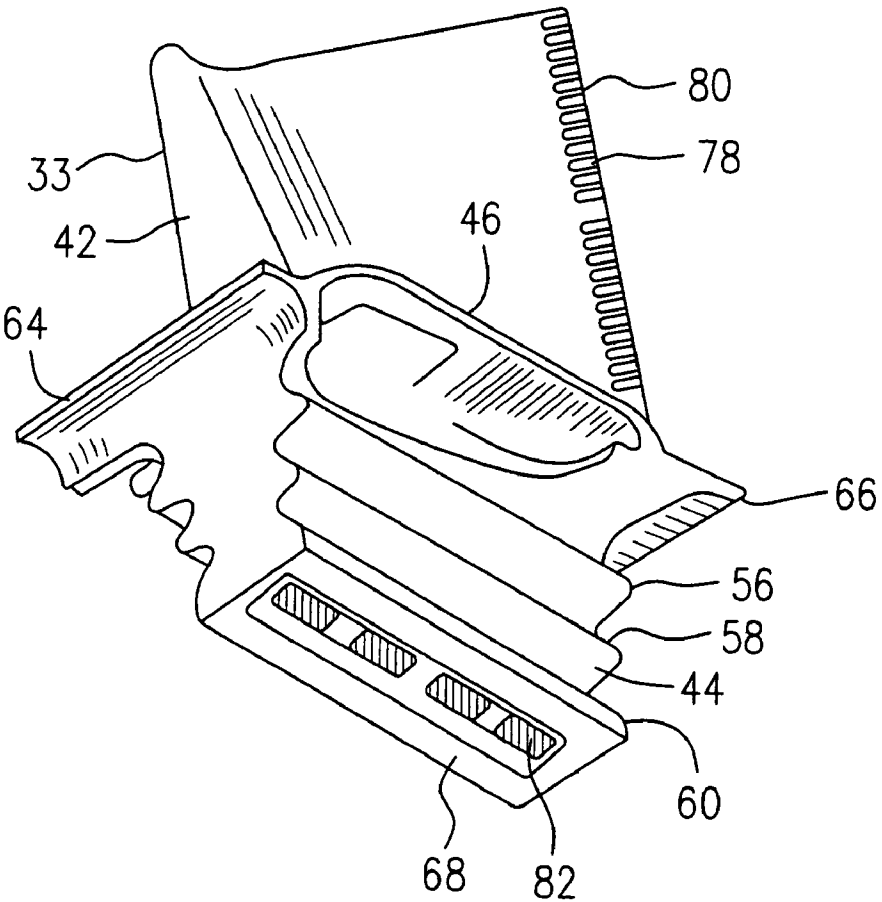
FIG. 5 is a perspective view of the front and bottom of the turbine blade of FIG. 4, showing the cooling flow entry into the blade.

Referring to FIGS. 2 and 6, forces on the firtree of the root section 44 are analysed. F indicates the radial pulling force created on the root section 44 of the turbine rotor blades 33, caused by the centrifugal loads due to blade rotation. Component F1 is the portion of F which is normal to the angled abutting retaining surfaces of the root section 44 and the attachment slot 62. The angle between the abutting retaining surfaces and the longitudinal axis 41 of the engine is indicated by A. F1 can be evaluated by the following:

$$F1 = F \cdot \cos A$$

F2 is the walk-off force which has a trend of pulling the root section 44 of the turbine rotor blade 33 to slide away from the attachment slot 62 of the turbine rotor disc 40. F2 is a component of F introduced by the angled abutting retaining surfaces of the root section 44 and the attachment slot 62, and can be evaluated by the following:

$$F2=F\cdot\sin A$$

When angle A is small, sin A is close to zero and on the other hand cos A is close to 1, resulting in a component F2 much smaller than component F1. Therefore, a small static friction coefficient is enough to provide a maximum static friction force (not shown) which results from component F1, to counter the blade walk-off force F2 and to prevent additional loads on a cover plate 74 which is positioned upstream of the turbine rotor disc 40 and abuts the front face 52 of the rim 50 thereof. Furthermore, the engine aerodynamic load created on turbine rotor blades 33 by the hot gas flow in the gas path 36 in FIG. 1, also acts against the blade walk-off. As a numerical example of the embodiment of this invention, with a 5° angle of A and a 0.3 static friction coefficient, 30,000 lbs of F load will yield the walk-off force F2 equalling 2,615 lbs and the maximum friction force of 8965 lbs. (0.3×F1), therefore the turbine rotor blade should not walk off.

Referring to FIGS. 1, 2, 3 and 5, the turbine rotor blade 33 preferably further includes an internal cooling flow passage which is not shown but is indicated by broken line arrows 76, for directing pressurized cooling air flow through the airfoil section 42 of the turbine rotor blades 33 and discharging same through a plurality of openings 78 on the trailing edge 80 of the airfoil section 42, as well as other airfoil cooling holes (not shown) into the gas path 36. In particular, the root section 44 includes at least one, but preferably a plurality of openings 82 in fluid communication with the internal blade cooling flow passage 76 and the tapered cavity 72. The tapered cavity 72 thereby provides a broach entry of the internal blade cooling flow passage 76 for receiving a pressurized cooling air flow (indicated by arrow 84) which is delivered from a pressurized cooling air source such as compressed air from compressor assembly 16 or 22, and is guided between the front cover plate 74 and the turbine rotor disc 40.

The present invention advantageously, not only accommodates the flared gas path configuration without increasing additional weight of the turbine rotor blades, but also increases the fixing contact area because of the firtree angle, thereby redueing stresses caused by the centrifugal load on the rotor section of the turbine rotor blades. The present invention also increases the blade cooling air feed pressure by increasing the broach air entiy area where cooling air penetrates from the TOBI (not shown) before entering the internal blade cooling flow passages, thereby reducing air entry speeds in the broach passage.

The above description is meant to be exemplary only, and one skilled in the art will recognize that changes may be made to the embodiments described without departing from the scope of the invention disclosed. For example, the angled firtree configuration of a turbine rotor blade can be used for blade fixing attachment of rotor assemblies of other types in the gas turbine engine such as the fan rotor assembly and the high or low pressure compressor rotor assembly. Furthermore, the acute angle direction toward the longitudinal axis of the engine can be either from a leading edge to a trailing edge, or from a trailing edge to a leading edge of the rotor blade, depending on individual embodiments required by the rotor assembly configuration. The tapered broach entry configuration for cooling purposes can be integrated or not integrated with the blade angled fixing attachment according to the present invention, depending on whether or not cooling requirements are required for the rotor assembly. Moreover, the blade angled fixing attachment principle of the present invention can be applied to gas turbine engines other than a turbofan type which is only an example to illustrate one application of the present invention. Still other modifications which fall within the scope of the present invention will be apparent to those skilled in the art, in light of a review of this disclosure, and such modifications are intended to fall within the appended claims.

The invention claimed is:

1. A turbine rotor assembly of a gas turbine engine, comprising:

a rotor disc having a plurality of blade attachment slots defined through a periphery of the disc;

an array of rotor blades extending outwardly from the blade attachment slots in the periphery of rotor disc, each of the rotor blades including an airfoil section having internal cooling passages therein, lobed blade root having an opening in communication with said cooling passages, and a platform extending laterally from the airfoil section, each blade root being disposed within a corresponding blade attachment slot, lobes of each respective blade root being received within mating anti-lobe portions of each respective slot, the mating lobes and anti-lobes extending axially in a radial plane of the turbine rotor assembly at an acute angle towards a longitudinal axis of the turbine rotor assembly, a cavity being defined between a bottom surface of the blade root and a floor of the corresponding attachment slot spaced apart from said bottom surface, the cavity in air flow communication with said opening; and wherein the blade root bottom surface extends generally towards the floor of the attachment slot so that the cavity is axially tapered towards said opening.

2. The turbine rotor assembly as claimed in claim 1 wherein said the bottom surface of the blade root is substantially parallel to the lobes and wherein the floor of the attachment slot is substantially parallel to the longitudinal axis.

3. The turbine rotor assembly as claimed in claim 1 wherein said platforms of the rotor blades define a varying radius with respect to the longitudinal axis of the, gas turbine engine, a radius at a leading edge of the platform being greater than a radius at a trailing edge of the platform.

4. A rotor assembly of a gas turbine engine, comprising:

a rotor disc defining a plurality of attachment slots circumferentially spaced apart one from another and extending axially through a periphery thereof;

an array of rotor blades extending outwardly from the periphery of the rotor disc, each of the rotor blades including an airfoil section, a blade root and platform segments extending laterally from sides of the airfoil section into opposing relationship with corresponding platform segments of adjacent rotor blades; and each pair of the blade roots and the attachment slots being co-operatively contoured in a substantially entire axial length of the rotor blade to provide abutting retaining surfaces of the respective blade root and the attachment slot, a bottom surface of the blade root extending from a leading edge to a trailing edge of the blade in a direction toward a longitudinal axis of the gas turbine engine combination with the attachment slot defining a tapered cavity extending substantially along said entire axial length of the rotor blade.

5. The rotor assembly as claimed in claim 4 wherein an abutting retaining surface of the blade root is formed by at least one projection on each of opposite sides of the blade root, the at least one projection extending in a direction of an acute angle with respect to the longitudinal axis of the gas turbine engine, and wherein an abutting retaining surface of the attachment slot is formed by at least one recess in each:of opposite side walls of the attachment slot, the at least one recess extending in said direction and being contoured for retaining the projection therein.

6. The rotor assembly as claimed in 5 wherein the bottom surface of the blade root extends in a direction substantially parallel to the at least one projection.

7. The rotor assembly as claimed in claim 4 wherein the tapered cavity is formed between bottom surface of the blade root and a bottom surface of the attachment slot of the rotor disc, the bottom surface of the attachment slot being substantially parallel to the longitudinal axis of the gas turbine engine.

8. The rotor assembly as claimed in claim 4 wherein each of the rotor blades comprises an internal cooling passage in fluid communication with a pressurized cooling air source, through the tapered cavity.

* * * * *